US010004286B2

(12) United States Patent
Salter et al.

(10) Patent No.: US 10,004,286 B2
(45) Date of Patent: Jun. 26, 2018

(54) GLOVE HAVING CONDUCTIVE INK AND METHOD OF INTERACTING WITH PROXIMITY SENSOR

(75) Inventors: Stuart C. Salter, White Lake, MI (US); Cornel Lewis Gardner, Romulus, MI (US); Jeffrey Singer, Canton, MI (US); Frank J. Desjarlais, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 1268 days.

(21) Appl. No.: 13/204,903

(22) Filed: Aug. 8, 2011

(65) Prior Publication Data

US 2013/0036529 A1 Feb. 14, 2013

(51) Int. Cl.
*A41D 19/00* (2006.01)

(52) U.S. Cl.
CPC ..... *A41D 19/0024* (2013.01); *A41D 19/0037* (2013.01)

(58) Field of Classification Search
CPC .. A41D 19/00; A41D 19/0006; A41D 19/001; A41D 19/0065; A41D 19/01547; A41D 19/01558; A41D 19/01564
USPC ..... 2/21, 163, 160, 161.3, 161.6, 161.7, 2/161.8; 345/173; 428/64.1, 317.1
See application file for complete search history.

(56) References Cited

U.S. PATENT DOCUMENTS 40,087 A * 9/1863 Waite ..... 2/163
1,911,500 A * 5/1933 Gowdy et al. ..... 2/161.8
2,120,406 A * 6/1938 Hansen ..... 2/168
3,283,888 A * 11/1966 Scott ..... 206/447
3,341,861 A * 9/1967 Robbins ..... 2/163
3,382,588 A 5/1968 Serrell et al.
3,544,804 A 12/1970 Gaumer et al.
3,691,396 A 9/1972 Hinrichs
3,707,671 A 12/1972 Morrow et al.
3,826,979 A 7/1974 Steinmann
4,172,293 A * 10/1979 Vistins ..... 2/169
4,204,204 A 5/1980 Pitstick
4,205,325 A 5/1980 Haygood et al.
4,232,289 A 11/1980 Daniel
4,257,117 A 3/1981 Besson
4,290,052 A 9/1981 Eichelberger et al.
4,340,813 A 7/1982 Sauer
(Continued)

FOREIGN PATENT DOCUMENTS

CN 201767105 U 3/2011
DE 4024052 1/1992
(Continued)

OTHER PUBLICATIONS

Van Ess, Dave et al., "Capacitive Touch Switches for Automotive Applications," 7 pages, Published in Automotive DesignLine, www.automotiedesignline.com, Feb. 2006.
(Continued)

*Primary Examiner* — Alissa L Hoey
(74) *Attorney, Agent, or Firm* — Vichit Chea; Price Heneveld LLP

(57) ABSTRACT

A glove is provided that includes a body configured to engage a hand and a plurality of finger sheaths configured to cover fingers of the hand. The glove also has an electrically conductive ink disposed at least at the tip of at least one of the finger sheaths to interact with a proximity sensor, such as a capacitive sensor.

16 Claims, 2 Drawing Sheets

(56) References Cited

U.S. PATENT DOCUMENTS 4,374,381 A 2/1983 Ng et al.
4,380,040 A 4/1983 Posset
4,413,252 A 11/1983 Tyler et al.
4,431,882 A 2/1984 Frame
4,446,380 A 5/1984 Moriya et al.
4,453,112 A 6/1984 Sauer et al.
4,492,958 A 1/1985 Minami
4,494,105 A 1/1985 House
4,502,726 A 3/1985 Adams
4,507,807 A * 4/1985 Karkanen ..... 2/161.8
4,514,817 A 4/1985 Pepper et al.
4,613,802 A 9/1986 Kraus et al.
4,680,429 A 7/1987 Murdock et al.
4,728,538 A * 3/1988 Kaspar et al. ..... 427/288
4,733,413 A * 3/1988 Dykstra ..... 2/169
4,743,895 A 5/1988 Alexander
4,748,390 A 5/1988 Okushima et al.
4,758,735 A 7/1988 Ingraham
4,821,029 A 4/1989 Logan et al.
4,855,550 A 8/1989 Schultz, Jr.
4,872,485 A 10/1989 Laverty, Jr.
4,881,276 A * 11/1989 Swan ..... 2/161.1
4,899,138 A 2/1990 Araki et al.
4,901,074 A 2/1990 Sinn et al.
4,905,001 A 2/1990 Penner
4,924,222 A 5/1990 Antikidis et al.
4,972,070 A 11/1990 Laverty, Jr.
5,025,516 A 6/1991 Wilson
5,033,508 A 7/1991 Laverty, Jr.
5,036,321 A 7/1991 Leach et al.
5,063,306 A 11/1991 Edwards
5,070,540 A * 12/1991 Bettcher et al. ..... 2/2.5
5,108,530 A 4/1992 Niebling, Jr. et al.
5,117,509 A * 6/1992 Bowers ..... 2/161.1
5,153,590 A 10/1992 Charlier
5,159,159 A 10/1992 Asher
5,159,276 A 10/1992 Reddy, III
5,177,341 A 1/1993 Balderson
5,215,811 A 6/1993 Reafler et al.
5,239,152 A 8/1993 Caldwell et al.
5,270,710 A 12/1993 Gaultier et al.
5,294,889 A 3/1994 Heep et al.
5,329,239 A 7/1994 Kindermann et al.
5,341,231 A 8/1994 Yamamoto et al.
5,403,980 A 4/1995 Eckrich
5,451,724 A 9/1995 Nakazawa et al.
5,467,080 A 11/1995 Stoll et al.
5,477,422 A 12/1995 Hooker et al.
5,493,899 A * 2/1996 Beck et al. ..... 73/40.7
5,494,180 A 2/1996 Callahan
5,499,400 A * 3/1996 Masuda et al. ..... 2/161.6
5,512,836 A 4/1996 Chen et al.
5,548,268 A 8/1996 Collins
5,566,702 A 10/1996 Philipp
5,572,205 A 11/1996 Caldwell et al.
5,581,812 A * 12/1996 Krocheski ..... 2/167
5,586,042 A 12/1996 Pisau et al.
5,594,222 A 1/1997 Caldwell
5,598,527 A 1/1997 Debrus et al.
5,661,853 A * 9/1997 Wilmot ..... 2/163
5,670,886 A 9/1997 Wolff et al.
5,681,515 A 10/1997 Pratt et al.
5,687,424 A * 11/1997 Masley ..... 2/163
5,706,522 A * 1/1998 Ballarino et al. ..... 2/161.6
5,730,165 A 3/1998 Philipp
5,747,756 A 5/1998 Boedecker
5,760,554 A 6/1998 Bustamante
5,790,107 A 8/1998 Kasser et al.
5,796,183 A 8/1998 Hourmand
5,825,352 A 10/1998 Bisset et al.
5,864,105 A 1/1999 Andrews
5,867,111 A 2/1999 Caldwell et al.
5,874,672 A 2/1999 Gerardi et al.
5,917,165 A 6/1999 Platt et al.
5,920,309 A 7/1999 Bisset et al.
5,942,733 A 8/1999 Allen et al.
5,963,000 A 10/1999 Tsutsumi et al.
5,973,417 A 10/1999 Goetz et al.
5,973,623 A 10/1999 Gupta et al.
6,009,557 A * 1/2000 Witta ..... 2/159
6,010,742 A 1/2000 Tanabe et al.
6,011,602 A 1/2000 Miyashita et al.
6,029,276 A * 2/2000 White ..... 2/161.6
6,031,465 A 2/2000 Burgess
6,035,180 A 3/2000 Kubes et al.
6,037,930 A 3/2000 Wolfe et al.
6,040,534 A 3/2000 Beukema
6,041,438 A * 3/2000 Kirkwood ..... 2/161.1
6,044,494 A * 4/2000 Kang ..... 2/167
6,098,199 A * 8/2000 Barkin ..... 2/159
6,157,372 A 12/2000 Blackburn et al.
6,172,666 B1 1/2001 Okura
6,209,137 B1 * 4/2001 Wallick ..... 2/161.1
6,215,476 B1 4/2001 Depew et al.
6,219,253 B1 4/2001 Green
6,231,111 B1 5/2001 Carter et al.
6,243,868 B1 * 6/2001 Wanzenried ..... 2/21
6,275,644 B1 8/2001 Domas et al.
6,288,707 B1 9/2001 Philipp
6,292,100 B1 9/2001 Dowling
6,310,611 B1 10/2001 Caldwell
6,320,282 B1 11/2001 Caldwell
6,323,919 B1 11/2001 Yang et al.
6,369,369 B2 4/2002 Kochman et al.
6,377,009 B1 4/2002 Philipp
6,379,017 B2 4/2002 Nakabayashi et al.
6,380,931 B1 4/2002 Gillespie et al.
6,408,442 B1 * 6/2002 Kang ..... 2/167
6,415,138 B2 7/2002 Sirola et al.
6,427,540 B1 8/2002 Monroe et al.
6,452,138 B1 9/2002 Kochman et al.
6,452,514 B1 9/2002 Philipp
6,456,027 B1 9/2002 Pruessel
6,457,355 B1 10/2002 Philipp
6,464,381 B2 10/2002 Anderson, Jr. et al.
6,466,036 B1 10/2002 Philipp
6,485,595 B1 11/2002 Yenni, Jr. et al.
6,529,125 B1 3/2003 Butler et al.
6,535,200 B2 3/2003 Philipp
6,537,359 B1 3/2003 Spa
6,559,902 B1 5/2003 Kusuda et al.
6,587,097 B1 7/2003 Aufderheide et al.
6,607,413 B2 8/2003 Stevenson et al.
6,614,579 B2 9/2003 Roberts et al.
6,617,975 B1 9/2003 Burgess
6,652,777 B2 11/2003 Rapp et al.
6,654,006 B2 11/2003 Kawashima et al.
6,661,410 B2 12/2003 Casebolt et al.
6,664,489 B2 12/2003 Kleinhans et al.
6,713,897 B2 3/2004 Caldwell
6,734,377 B2 5/2004 Gremm et al.
6,738,051 B2 5/2004 Boyd et al.
6,740,416 B1 5/2004 Yokogawa et al.
6,756,970 B2 6/2004 Keely, Jr. et al.
6,773,129 B2 8/2004 Anderson, Jr. et al.
6,773,614 B2 * 8/2004 Field ..... 216/5
6,774,505 B1 8/2004 Wnuk
6,794,728 B1 9/2004 Kithil
6,795,226 B2 9/2004 Agrawal et al.
6,809,280 B2 10/2004 Divigalpitiya et al.
6,812,424 B2 11/2004 Miyako
6,819,316 B2 11/2004 Schulz et al.
6,819,990 B2 11/2004 Ichinose
6,825,752 B2 11/2004 Nahata et al.
6,834,373 B2 12/2004 Dieberger
6,841,748 B2 1/2005 Serizawa et al.
6,847,018 B2 1/2005 Wong
6,879,250 B2 4/2005 Fayt et al.
6,884,936 B2 4/2005 Takahashi et al.
6,891,114 B2 5/2005 Peterson
6,891,530 B2 5/2005 Umemoto et al.
6,897,390 B2 5/2005 Caldwell et al.
6,904,614 B2 * 6/2005 Yamazaki et al. ..... 2/159
6,929,900 B2 8/2005 Farquhar et al.

(56) References Cited

U.S. PATENT DOCUMENTS 6,930,672 B1 8/2005 Kuribayashi
6,940,291 B1 9/2005 Ozick
6,960,735 B2 11/2005 Hein et al.
6,964,023 B2 11/2005 Maes et al.
6,966,225 B1 11/2005 Mallary
6,967,587 B2 11/2005 Snell et al.
6,977,615 B2 12/2005 Brandwein, Jr.
6,987,605 B2 1/2006 Liang et al.
6,993,607 B2 1/2006 Philipp
6,999,066 B2 2/2006 Litwiller
7,030,513 B2 4/2006 Caldwell
7,037,447 B1 * 5/2006 Yang et al. ..... 252/512
7,046,129 B2 5/2006 Regnet et al.
7,053,360 B2 5/2006 Balp et al.
7,063,379 B2 6/2006 Steuer et al.
7,091,886 B2 8/2006 DePue et al.
7,098,414 B2 8/2006 Caldwell
7,105,752 B2 9/2006 Tsai et al.
7,106,171 B1 9/2006 Burgess
7,135,995 B2 11/2006 Engelmann et al.
7,146,024 B2 12/2006 Benkley, III
7,151,450 B2 12/2006 Beggs et al.
7,151,532 B2 12/2006 Schulz
7,154,481 B2 12/2006 Cross et al.
7,159,246 B2 * 1/2007 Tippey ..... 2/163
7,180,017 B2 2/2007 Hein
7,186,936 B2 3/2007 Marcus et al.
7,205,777 B2 4/2007 Schulz et al.
7,215,529 B2 5/2007 Rosenau
7,218,498 B2 5/2007 Caldwell
7,232,973 B2 6/2007 Kaps et al.
7,242,393 B2 7/2007 Caldwell
7,245,131 B2 7/2007 Kurachi et al.
7,248,151 B2 7/2007 McCall
7,248,955 B2 7/2007 Hein et al.
7,254,775 B2 8/2007 Geaghan et al.
7,255,466 B2 8/2007 Schmidt et al.
7,255,622 B2 8/2007 Stevenson et al.
7,269,484 B2 9/2007 Hein
7,295,168 B2 11/2007 Saegusa et al.
7,295,904 B2 11/2007 Kanevsky et al.
7,339,579 B2 3/2008 Richter et al.
7,342,485 B2 3/2008 Joehl et al.
7,346,935 B1 * 3/2008 Patterson ..... 2/239
7,355,595 B2 4/2008 Bathiche et al.
7,361,860 B2 4/2008 Caldwell
7,385,308 B2 6/2008 Yerdon et al.
7,445,350 B2 11/2008 Konet et al.
7,479,788 B2 1/2009 Bolender et al.
7,489,053 B2 2/2009 Gentile et al.
7,521,941 B2 4/2009 Ely et al.
7,521,942 B2 4/2009 Reynolds
7,531,921 B2 5/2009 Cencur
7,532,202 B2 5/2009 Roberts
7,535,131 B1 5/2009 Safieh, Jr.
7,535,459 B2 5/2009 You et al.
7,567,240 B2 7/2009 Peterson, Jr. et al.
7,583,092 B2 9/2009 Reynolds et al.
7,643,010 B2 1/2010 Westerman et al.
7,653,883 B2 1/2010 Hotelling et al.
7,688,080 B2 3/2010 Golovchenko et al.
7,701,440 B2 4/2010 Harley
7,705,257 B2 4/2010 Arione et al.
7,708,120 B2 5/2010 Einbinder
7,714,846 B1 5/2010 Gray
7,719,142 B2 5/2010 Hein et al.
7,728,819 B2 6/2010 Inokawa
7,737,953 B2 6/2010 Mackey
7,737,956 B2 6/2010 Hsieh et al.
7,777,732 B2 8/2010 Herz et al.
7,782,307 B2 8/2010 Westerman et al.
7,791,594 B2 9/2010 Dunko
7,795,882 B2 9/2010 Kirchner et al.
7,800,590 B2 9/2010 Satoh et al.
7,814,571 B2 * 10/2010 Thompson et al. ..... 2/161.6
7,821,425 B2 10/2010 Philipp
7,834,853 B2 11/2010 Finney et al.
7,839,392 B2 11/2010 Pak et al.
7,876,310 B2 1/2011 Westerman et al.
7,881,940 B2 2/2011 Dusterhoff
7,884,797 B1 * 2/2011 Ning ..... 345/156
RE42,199 E 3/2011 Caldwell
7,898,531 B2 3/2011 Bowden et al.
7,920,131 B2 4/2011 Westerman
7,924,143 B2 4/2011 Griffin et al.
7,957,864 B2 6/2011 Lenneman et al.
7,978,181 B2 7/2011 Westerman
7,989,752 B2 8/2011 Yokozawa
8,001,809 B2 * 8/2011 Thompson et al. ..... 66/174
8,026,904 B2 9/2011 Westerman
8,050,876 B2 11/2011 Feen et al.
8,054,296 B2 11/2011 Land et al.
8,054,300 B2 11/2011 Bernstein
8,077,154 B2 12/2011 Emig et al.
8,090,497 B2 1/2012 Ando
8,253,425 B2 8/2012 Reynolds et al.
8,283,800 B2 10/2012 Salter et al.
8,302,215 B2 * 11/2012 Matsunobu et al. ..... 2/161.6
8,330,385 B2 12/2012 Salter et al.
8,336,119 B2 * 12/2012 Phelps et al. ..... 2/167
8,339,286 B2 12/2012 Cordeiro
8,347,414 B2 * 1/2013 Terpinski ..... 2/161.6
8,400,256 B2 * 3/2013 Matthews ..... 338/99
8,454,181 B2 6/2013 Salter et al.
8,508,487 B2 8/2013 Schwesig et al.
8,528,117 B2 * 9/2013 Asiaghi ..... 2/167
2001/0019228 A1 9/2001 Gremm
2001/0028558 A1 10/2001 Rapp et al.
2002/0040266 A1 4/2002 Edgar et al.
2002/0084721 A1 7/2002 Walczak
2002/0093786 A1 7/2002 Maser
2002/0149376 A1 10/2002 Haffner et al.
2002/0167439 A1 11/2002 Bloch et al.
2002/0167704 A1 11/2002 Kleinhans et al.
2003/0002273 A1 1/2003 Anderson, Jr. et al.
2003/0056278 A1 * 3/2003 Kuo et al. ..... 2/160
2003/0122554 A1 7/2003 Karray et al.
2004/0046734 A1 * 3/2004 Hart ..... 345/156
2004/0056753 A1 3/2004 Chiang et al.
2004/0145613 A1 7/2004 Stavely et al.
2004/0160072 A1 8/2004 Carter et al.
2004/0160713 A1 8/2004 Wei
2004/0197547 A1 10/2004 Bristow et al.
2004/0237170 A1 * 12/2004 Yamazaki et al. ..... 2/159
2004/0246239 A1 12/2004 Knowles et al.
2005/0052429 A1 3/2005 Philipp
2005/0068712 A1 3/2005 Schulz et al.
2005/0088417 A1 4/2005 Mulligan
2005/0110769 A1 5/2005 DaCosta et al.
2005/0132467 A1 * 6/2005 Tippey ..... 2/159
2005/0137765 A1 6/2005 Hein et al.
2005/0210652 A1 * 9/2005 Epstein ..... 29/463
2005/0223469 A1 * 10/2005 Banton ..... 2/160
2005/0231471 A1 * 10/2005 Mallard et al. ..... 345/156
2005/0242923 A1 11/2005 Pearson et al.
2006/0038793 A1 2/2006 Philipp
2006/0044800 A1 3/2006 Reime
2006/0082545 A1 4/2006 Choquet et al.
2006/0221066 A1 * 10/2006 Cascella ..... 345/179
2006/0244733 A1 11/2006 Geaghan
2006/0262549 A1 11/2006 Schmidt et al.
2006/0267953 A1 11/2006 Peterson, Jr. et al.
2006/0279015 A1 12/2006 Wang
2006/0282937 A1 * 12/2006 Morris ..... 2/163
2006/0287474 A1 12/2006 Crawford et al.
2007/0008726 A1 1/2007 Brown
2007/0023265 A1 2/2007 Ishikawa et al.
2007/0051609 A1 3/2007 Parkinson
2007/0068790 A1 3/2007 Yerdon et al.
2007/0083980 A1 * 4/2007 Yang et al. ..... 2/167
2007/0096565 A1 5/2007 Breed et al.
2007/0103431 A1 5/2007 Tabatowski-Bush
2007/0204381 A1 * 9/2007 Thompson et al. ..... 2/159
2007/0221658 A1 * 9/2007 Cates et al. ..... 219/529

(56) References Cited

U.S. PATENT DOCUMENTS

2007/0226994 A1 10/2007 Wollach et al.
2007/0232779 A1 10/2007 Moody et al.
2007/0245454 A1* 10/2007 Eklund ..... 2/161.6
2007/0247429 A1 10/2007 Westerman
2007/0255468 A1 11/2007 Strebel et al.
2007/0257891 A1 11/2007 Esenther et al.
2007/0296709 A1 12/2007 GuangHai
2008/0010718 A1* 1/2008 Richards ..... 2/159
2008/0012835 A1 1/2008 Rimon et al.
2008/0018604 A1 1/2008 Paun et al.
2008/0023715 A1 1/2008 Choi
2008/0030465 A1 2/2008 Konet et al.
2008/0060111 A1* 3/2008 Baacke et al. ..... 2/69
2008/0111714 A1 5/2008 Kremin
2008/0136792 A1 6/2008 Peng et al.
2008/0143681 A1 6/2008 XiaoPing
2008/0150905 A1 6/2008 Grivna et al.
2008/0158146 A1 7/2008 Westerman
2008/0196945 A1 8/2008 Konstas
2008/0202912 A1 8/2008 Boddie et al.
2008/0231290 A1 9/2008 Zhitomirsky
2008/0238650 A1 10/2008 Riihimaki et al.
2008/0257706 A1 10/2008 Haag
2008/0272623 A1 11/2008 Kadzban et al.
2008/0316182 A1* 12/2008 Antila et al. ..... 345/173
2009/0007313 A1* 1/2009 Boorsma et al. ..... 2/161.8
2009/0013441 A1* 1/2009 Duffy ..... 2/21
2009/0055992 A1* 3/2009 Thompson et al. ..... 2/164
2009/0066658 A1* 3/2009 Earl ..... 345/173
2009/0066659 A1 3/2009 He et al.
2009/0079699 A1 3/2009 Sun
2009/0108985 A1 4/2009 Haag et al.
2009/0115731 A1 5/2009 Rak
2009/0120697 A1 5/2009 Wilner et al.
2009/0126074 A1* 5/2009 Mattesky ..... 2/161.8
2009/0135157 A1 5/2009 Harley
2009/0139007 A1* 6/2009 Bevier ..... 2/161.1
2009/0183297 A1* 7/2009 Drosihn ..... 2/167
2009/0188019 A1* 7/2009 Hassan et al. ..... 2/161.7
2009/0225043 A1 9/2009 Rosener
2009/0235588 A1 9/2009 Patterson et al.
2009/0236210 A1 9/2009 Clark et al.
2009/0251435 A1 10/2009 Westerman et al.
2009/0271906 A1* 11/2009 Lee ..... 2/21
2009/0309616 A1 12/2009 Klinghult et al.
2009/0313738 A1* 12/2009 Young ..... 2/21
2009/0322685 A1* 12/2009 Lee ..... 345/173
2010/0001974 A1 1/2010 Su et al.
2010/0005562 A1* 1/2010 Park ..... 2/160
2010/0007613 A1 1/2010 Costa
2010/0007620 A1 1/2010 Hsieh et al.
2010/0011484 A1* 1/2010 Williams ..... 2/161.8
2010/0013777 A1 1/2010 Baudisch et al.
2010/0026654 A1 2/2010 Suddreth
2010/0039392 A1 2/2010 Pratt et al.
2010/0090712 A1 4/2010 VAndermeijden
2010/0090966 A1 4/2010 Gregorio
2010/0102830 A1 4/2010 Curtis et al.
2010/0103139 A1 4/2010 Soo et al.
2010/0104750 A1* 4/2010 Kassam et al. ..... 427/243
2010/0104762 A1* 4/2010 Kassam et al. ..... 427/337
2010/0110037 A1 5/2010 Huang et al.
2010/0125393 A1 5/2010 Jarvinen et al.
2010/0140564 A1* 6/2010 Overbreek et al. ..... 252/514
2010/0156814 A1 6/2010 Weber et al.
2010/0177057 A1 7/2010 Flint et al.
2010/0188356 A1 7/2010 Vu et al.
2010/0188364 A1 7/2010 Lin et al.
2010/0194692 A1 8/2010 Orr et al.
2010/0207907 A1 8/2010 Tanabe et al.
2010/0214253 A1 8/2010 Wu et al.
2010/0241431 A1 9/2010 Weng et al.
2010/0241983 A1 9/2010 Walline et al.
2010/0242153 A1* 9/2010 Harrison ..... 2/160
2010/0245286 A1 9/2010 Parker
2010/0250071 A1 9/2010 Pala et al.
2010/0277431 A1 11/2010 Klinghult
2010/0280983 A1 11/2010 Cho et al.
2010/0286867 A1 11/2010 Bergholz et al.
2010/0289754 A1 11/2010 Sleeman et al.
2010/0289759 A1 11/2010 Fisher et al.
2010/0296303 A1 11/2010 Sarioglu et al.
2010/0315267 A1 12/2010 Chung et al.
2010/0321214 A1 12/2010 Wang et al.
2010/0321321 A1 12/2010 Shenfield et al.
2010/0321335 A1 12/2010 Lim et al.
2010/0325777 A1* 12/2010 Radhakrishnan et al. ..... 2/161.1
2010/0328261 A1 12/2010 Woolley et al.
2010/0328262 A1 12/2010 Huang et al.
2011/0001707 A1 1/2011 Faubert et al.
2011/0001722 A1 1/2011 Newman et al.
2011/0007021 A1 1/2011 Bernstein et al.
2011/0007023 A1 1/2011 Abrahamsson et al.
2011/0012623 A1 1/2011 Gastel et al.
2011/0016609 A1* 1/2011 Phelps et al. ..... 2/162
2011/0018744 A1 1/2011 Philipp
2011/0018817 A1 1/2011 Kryze et al.
2011/0022393 A1 1/2011 Waller et al.
2011/0031983 A1 2/2011 David et al.
2011/0034219 A1 2/2011 Filson et al.
2011/0037725 A1 2/2011 Pryor
2011/0037735 A1 2/2011 Land et al.
2011/0039602 A1 2/2011 McNamara et al.
2011/0043481 A1 2/2011 Bruwer
2011/0047672 A1* 3/2011 Hatfield ..... 2/163
2011/0050251 A1 3/2011 Franke et al.
2011/0050587 A1 3/2011 Natanzon et al.
2011/0050618 A1 3/2011 Murphy et al.
2011/0050620 A1 3/2011 Hristov
2011/0055753 A1 3/2011 Horodezky et al.
2011/0062969 A1 3/2011 Hargreaves et al.
2011/0063425 A1 3/2011 Tieman
2011/0074573 A1 3/2011 Seshadri
2011/0080365 A1 4/2011 Westerman
2011/0080366 A1 4/2011 Bolender
2011/0080376 A1 4/2011 Kuo et al.
2011/0082616 A1 4/2011 Small et al.
2011/0083110 A1 4/2011 Griffin et al.
2011/0095997 A1 4/2011 Philipp
2011/0115732 A1 5/2011 Coni et al.
2011/0115742 A1 5/2011 Sobel et al.
2011/0134047 A1 6/2011 Wigdor et al.
2011/0134054 A1 6/2011 Woo et al.
2011/0141006 A1 6/2011 Rabu
2011/0141041 A1 6/2011 Parkinson et al.
2011/0145967 A1* 6/2011 Hull ..... 2/16
2011/0148803 A1 6/2011 Xu
2011/0157037 A1 6/2011 Shamir et al.
2011/0157079 A1 6/2011 Wu et al.
2011/0157080 A1 6/2011 Ciesla et al.
2011/0157089 A1 6/2011 Rainisto
2011/0161001 A1 6/2011 Fink
2011/0169758 A1 7/2011 Aono
2011/0187492 A1 8/2011 Newman et al.
2011/0209504 A1* 9/2011 Thompson et al. ..... 66/174
2011/0221709 A1* 9/2011 Yao et al. ..... 345/179
2011/0265245 A1* 11/2011 Asiaghi ..... 2/167
2011/0278061 A1* 11/2011 Farnan ..... 174/70 R
2011/0279276 A1 11/2011 Newham
2011/0279409 A1 11/2011 Salaverry et al.
2011/0289652 A1* 12/2011 Thompson et al. ..... 2/164
2011/0289654 A1* 12/2011 Williams et al. ..... 2/167
2012/0007821 A1 1/2012 Zaliva
2012/0037485 A1 2/2012 Sitarski
2012/0042437 A1* 2/2012 Matthews ..... 2/160
2012/0043976 A1 2/2012 Bokma et al.
2012/0049870 A1 3/2012 Salter et al.
2012/0062247 A1 3/2012 Chang
2012/0062498 A1 3/2012 Weaver et al.
2012/0068956 A1 3/2012 Jira et al.
2012/0096620 A1* 4/2012 Baacke ..... 2/69
2012/0096621 A1* 4/2012 Baacke ..... 2/69
2012/0098785 A1* 4/2012 Tatelbaum et al. ..... 345/174
2012/0137403 A1* 6/2012 Bone et al. ..... 2/163

(56) References Cited

U.S. PATENT DOCUMENTS

| | | | | |
|---|---|---|---|---|
| 2012/0154324 | A1 | 6/2012 | Wright et al. | |
| 2012/0157263 | A1* | 6/2012 | Sivak et al. | 482/4 |
| 2012/0188182 | A1* | 7/2012 | McKenna | 345/173 |
| 2012/0240308 | A1* | 9/2012 | Thompson | 2/164 |
| 2012/0308806 | A1* | 12/2012 | Leto et al. | 428/317.1 |
| 2012/0312676 | A1 | 12/2012 | Salter et al. | |
| 2012/0313648 | A1 | 12/2012 | Salter et al. | |
| 2013/0021292 | A1* | 1/2013 | Tatelbaum et al. | 345/174 |
| 2013/0036529 | A1* | 2/2013 | Salter et al. | 2/163 |
| 2013/0076121 | A1 | 3/2013 | Salter et al. | |
| 2013/0076699 | A1* | 3/2013 | Spencer | 345/179 |
| 2013/0093500 | A1 | 4/2013 | Bruwer | |
| 2013/0104285 | A1* | 5/2013 | Nolan | 2/163 |
| 2013/0113397 | A1 | 5/2013 | Salter et al. | |
| 2013/0113544 | A1 | 5/2013 | Salter et al. | |
| 2013/0168222 | A1* | 7/2013 | Ning | 200/600 |
| 2013/0180027 | A1* | 7/2013 | Rock | 2/167 |
| 2013/0191962 | A1* | 8/2013 | Alves | 2/167 |
| 2013/0270896 | A1 | 10/2013 | Buttolo et al. | |
| 2013/0270899 | A1 | 10/2013 | Buttolo et al. | |
| 2013/0271157 | A1 | 10/2013 | Buttolo et al. | |
| 2013/0271182 | A1 | 10/2013 | Buttolo et al. | |
| 2013/0271202 | A1 | 10/2013 | Buttolo et al. | |
| 2013/0271203 | A1 | 10/2013 | Salter et al. | |
| 2013/0271204 | A1 | 10/2013 | Salter et al. | |
| 2013/0291280 | A1* | 11/2013 | Cheng | 2/160 |
| 2013/0307610 | A1 | 11/2013 | Salter et al. | |
| 2013/0321065 | A1 | 12/2013 | Salter et al. | |
| 2013/0328616 | A1 | 12/2013 | Buttolo et al. | |
| 2014/0002405 | A1 | 1/2014 | Salter et al. | |
| 2014/0123366 | A1* | 5/2014 | Thompson et al. | 2/164 |

FOREIGN PATENT DOCUMENTS

| | | |
|---|---|---|
| EP | 1152443 | 11/2001 |
| EP | 1327860 | 7/2003 |
| EP | 1562293 | 8/2005 |
| EP | 2133777 | 10/2011 |
| GB | 2071338 | 9/1981 |
| GB | 2158737 | 11/1985 |
| GB | 2279750 | 1/1995 |
| GB | 2409578 | 6/2005 |
| GB | 2418741 | 4/2006 |
| JP | 61188515 | 8/1986 |
| JP | 4065038 | 3/1992 |
| JP | 04082416 | 3/1992 |
| JP | 07315880 | 12/1995 |
| JP | 08138446 | 5/1996 |
| JP | 11065764 | 3/1999 |
| JP | 11110131 | 4/1999 |
| JP | 11260133 | 9/1999 |
| JP | 1316553 | 11/1999 |
| JP | 2000047178 | 2/2000 |
| JP | 2000075293 | 3/2000 |
| JP | 2001013868 | 1/2001 |
| JP | 2006007764 | 1/2006 |
| JP | 2007027034 | 2/2007 |
| JP | 2008033701 | 2/2008 |
| JP | 2010139362 | 6/2010 |
| JP | 2010165618 | 7/2010 |
| JP | 2010218422 | 9/2010 |
| JP | 2010239587 | 10/2010 |
| JP | 2010287148 | 12/2010 |
| JP | 2011014280 | 1/2011 |
| KR | 20040110463 | 12/2004 |
| KR | 20090127544 | 12/2009 |
| KR | 20100114768 | 10/2010 |
| WO | 9636960 | 11/1996 |
| WO | 9963394 | 12/1999 |
| WO | 2006093398 | 9/2006 |
| WO | 2007022027 | 2/2007 |
| WO | 2008121760 | 10/2008 |
| WO | 2009054592 | 4/2009 |
| WO | 2010111362 | 9/2010 |
| WO | 2012032318 | 3/2012 |
| WO | 2012169106 | 12/2012 |

OTHER PUBLICATIONS

"Introduction to Touch Solutions, White Paper, Rivision 1.0 A," Densitron Corporation, 14 pages, Aug. 21, 2007.

Kliffken, Marksu G. et al., "Obstacle Detection for Power Operated Window-Lift and Sunroof Actuation Systems," Paper No. 2001-01-0466, 1 page, © 2011 SAE International, Published Mar. 5, 2001.

NXP Capacitive Sensors, 1 page, www.nxp.com, copyrighted 2006-2010, NXP Semiconductors.

"Moisture Immunity in QuickSense Studio," AN552, Rev. 0.1 10/10, 8 pages, Silicon Laboratories, Inc., © 2010.

"Touch Sensors Design Guide" by ATMEL, 10620 D-AT42-04/09, Revised Apr. 2009, 72 pages, Copyrighted 2008-2009 Atmel Corporation.

"Charge-Transfer Sensing-Based Touch Controls Facilitate Creative Interfaces," www.ferret.com.au, 2 pages, Jan. 18, 2006.

Kiosk Peripherals, "Touch Screen," www.bitsbytesintegrators.com/kiosk-peripherals.html, 10 pages, no date provided.

JVC KD-AVX777 Detachable Front-Panel with Integrated 5.4' Touch-Screen Monitor, 6 pages, www.crutchfield.com, no date provided.

Ergonomic Palm Buttons, Pepperl+Fuchs, www.wolfautomation.com, 6 pages, no date provided.

Orgacon EL-P3000, Screenprinting Ink Series 3000, AGFA, 2 pages, Updated Feb. 2006.

Clevios PFormulation Guide, Heraeus, www.clevios.com, 12 pages, no date provided.

U.S. Appl. No. 13/609,390, filed Sep. 11, 2012, entitled "Proximity Switch Based Door Latch Release," (14 pages of specification and 4 pages of drawings) and Official Filing Receipt (3 pages).

U.S. Appl. No. 13/665,253, filed Oct. 31, 2012, entitled Proximity Switch Assembly Having Round Layer, (15 pages of specification and 7 pages of drawings) and Official Filing Receipt (3 pages).

U.S. Appl. No. 13/799,413, filed Mar. 13, 2013, entitled "Proximity Interface Development System Having Replicator and Method," (29 pages of specification and 20 pages of drawings) and Official Filing Receipt (3 pages).

U.S. Appl. No. 13/799,478, filed Mar. 13, 2013, entitled "Proximity Interface Development System Having Analyzer and Method," (29 pages of specification and 20 pages of drawings) and Official Filing Receipt (3 pages).

U.S. Appl. No. 14/168,614, filed Jan. 30, 2014, entitled "Proximity Switch Assembly and Activation Method Having Virtual Button Mode," (30 pages of specification and 15 pages of drawings) and Official Filing Receipt (3 pages).

* cited by examiner

GLOVE HAVING CONDUCTIVE INK AND METHOD OF INTERACTING WITH PROXIMITY SENSOR

FIELD OF THE INVENTION

The present invention generally relates to activation of proximity sensors, and more particularly relates to an enhanced conductivity glove and method of interacting with a proximity sensor, such as a capacitive sensor.

BACKGROUND OF THE INVENTION

Various electronic devices, such as consumer electronic devices, employ touch screen inputs, typically in the form of capacitive touch screen sensors. Additionally, automotive vehicles are being equipped with proximity sensors, such as capacitive sensors, which may be used as switches to control various devices and perform various functions onboard the vehicle. Capacitive switches typically employ one or more proximity sensors to generate a sense activation field and sense changes to the activation field indicative of user activation of the sensor, which is typically caused by a user's finger in close proximity or contact with the sensor. Proximity sensors are typically configured to detect user activation of the sensor based on comparison of the sense activation field to a threshold.

Generally, capacitive sensors sense a touch of the bare hand of a user, such as the fleshy fingertip, due to conductivity of the flesh, which perturbs the activation field. Problems often arise when a user wears protective gloves that cover the hands, such as for work or during cold weather conditions. Many devices employing capacitive sensing technology are generally inoperable for users wearing gloves because the material of the glove typically acts as an electrical insulator that isolates the finger and prevents the detection of the conductivity of the fingertips of the hand. This can become a problem, especially for automotive applications in which users often enter a vehicle during cold conditions and employ the vehicle in a work environment where gloves are advantageously worn by a user. It has been proposed to manufacture conductive material in gloves, however, conventional proposals typically require fabrication of the glove to include the conductive material. It is desirable to provide for a glove and methodology of employing a glove that allows for easy use of capacitive sensors by a user without requiring extensive modification of the glove.

SUMMARY OF THE INVENTION

According to one aspect of the present invention, a glove is provided that includes a body configured to engage a hand and a plurality of finger sheaths configured to cover fingers of the hand. The glove also includes an electrically conductive ink disposed on at least one of the finger sheaths.

According to another aspect of the present invention, a glove is provided that includes a body configured to receive a hand. The glove also includes a plurality of sheaths configured to cover fingers of the hand. The glove further includes an electrically conductive material disposed on at least one of the sheaths, wherein the electrically conductive material is formed by applying a liquid conductive ink to the at least one sheath and drying the conductive ink.

According to a further aspect of the present invention, a method of interacting a proximity sensor with a hand wearing a glove is provided, wherein the glove has finger sheaths that cover fingers of the hand. The method includes the steps of applying a liquid conductive ink to at least one finger sheath and drying the conductive ink. The method also includes the step of moving the finger sheath toward a proximity sensor to activate the proximity sensor with the dried conductive ink.

These and other aspects, objects, and features of the present invention will be understood and appreciated by those skilled in the art upon studying the following specification, claims, and appended drawings.

DETAILED DESCRIPTION OF THE PREFERRED EMBODIMENTS

As required, detailed embodiments of the present invention are disclosed herein; however, it is to be understood that the disclosed embodiments are merely exemplary of the invention that may be embodied in various and alternative forms. The figures are not necessarily to a detailed design; some schematics may be exaggerated or minimized to show function overview. Therefore, specific structural and functional details disclosed herein are not to be interpreted as limiting, but merely as a representative basis for teaching one skilled in the art to variously employ the present invention.

Figure 1:
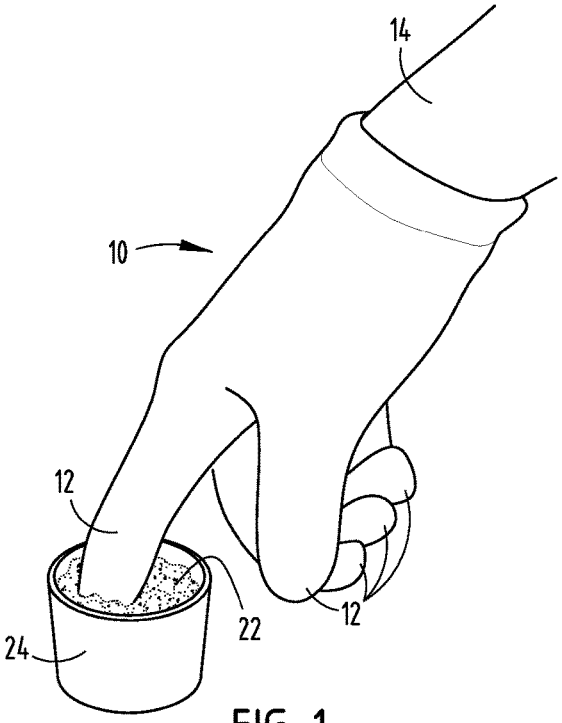
FIG. 1 is a perspective view of a glove worn by a user illustrating the step of applying a liquid conductive ink to the tip of a sheath by dipping the glove in the ink, according to one embodiment.
Figure 2:
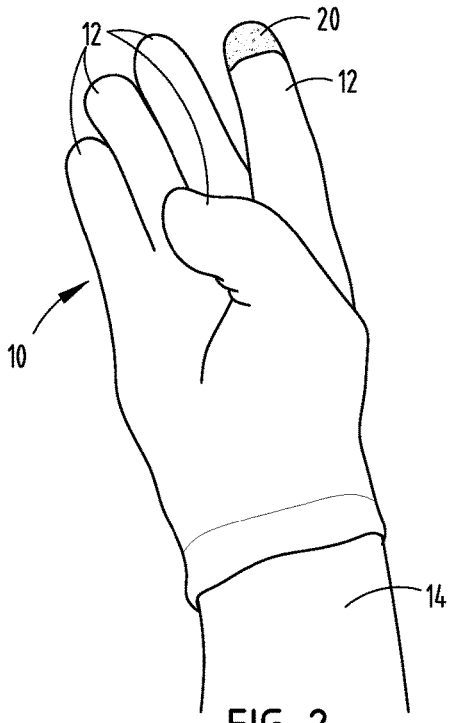
FIG. 2 is a perspective view of the glove illustrating the step of drying the conductive ink such that glove may be used to operate a proximity (e.g., capacitive) sensor.
Figure 3:
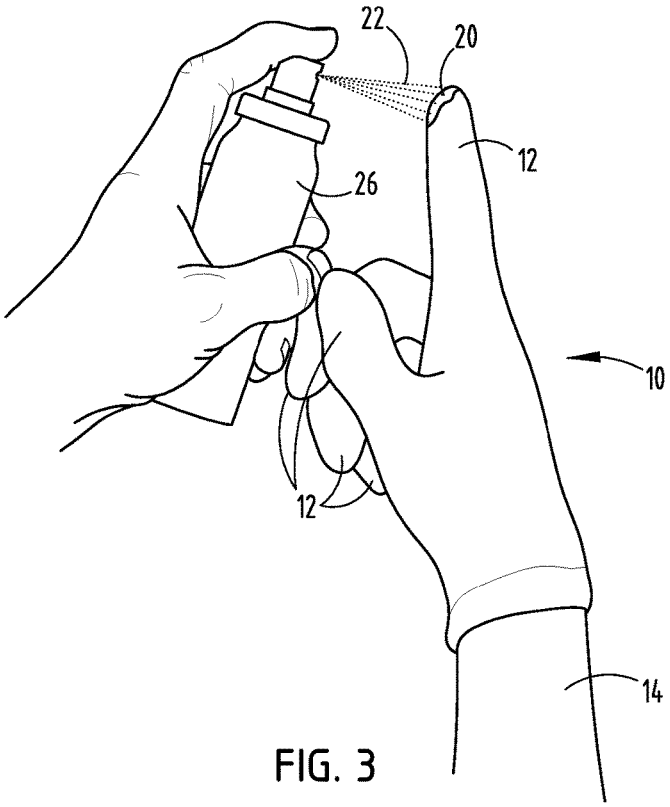
FIG. 3 is a perspective view of the application of a liquid conductive ink to the tip of a sheath by spraying the liquid conductive ink thereon, according to another embodiment.

Referring to FIGS. 1-3, a glove 10 is generally illustrated configured to be worn on a hand 14 of a user, and configured to provide enhanced interaction with a proximity sensor, such as a capacitive sensor. The glove 10 is shown in FIG. 1 during the step of applying a clear or transparent conductive ink to a tip portion of at least one finger sheath of the glove 10, according to one embodiment. The glove 10 generally includes a body configured to cover the hand including the palm and backside of the hand, according to a conventional style glove. The glove 10 also includes a plurality of finger sheaths 12 configured to individually cover the fingers or digits of the hand. Each sheath has a tip at the proximal end of the sheath 12. At least one of the finger sheaths 12 is configured to have an electrically conductive material in the form of a clear conductive ink applied to at least one of the tips of the finger sheaths 12 such that the glove 10 may advantageously be employed to interact with or operate a proximity sensor, such as a capacitive sensor, with enhanced sensing capability.

As shown in FIG. 1, the glove 12 worn by a user is modified by applying a clear conductive liquid ink to at least the tip portion of at least one of the sheaths 12. This may be achieved by a user wearing the glove 10 on the hand thereof and inserting at least one finger and the tip of the covering sheath 12 into a liquid bath of clear highly transparent conductive ink 22 shown disposed within container 24. It should be appreciated that a user may select from many different types or styles of gloves and may easily modify the electrical conductivity of the glove 10 by applying a clear conductive ink to a sheath portion 12 so as to advantageously provide for an enhanced capacitive sensor operating glove. The container 24 of clear conductive bath 22 may be a small container of liquid conductive ink that may be readily transportable and made available to a user for an initial application to the glove 10 or made available for reapplying an application of conductive ink to the glove 10 to enhance electrical conductivity characteristics of the glove 10 for use with proximity sensors.

Once a sufficient amount of the tip portion of the sheath 12 is coated with the liquid conductive ink, the glove 10 is removed from the bath 22 of container 24 and the liquid conductive ink 22 is allowed to dry as shown in FIG. 2. The conductive ink 22 dries on the glove 10 to form a dried conductive portion 20 which may advantageously be used to provide enhanced operation of or interaction with a proximity sensor, such as a capacitive sensor. Once dried, the ink remains highly transparent. By employing a clear or visibly transparent conductive ink, the color and look of the glove 10 may appear to remain unchanged to the visible eye of a user (human). As a result, different types of gloves employing different materials and colors may be employed and the look of the glove 10 may not visibly appear to be changed due to the application of the clear conductive ink; however, the electrical conductivity characteristics of the glove 10 is enhanced by employing the clear conductive ink to enhance the capacitive sensing characteristic.

Referring to FIG. 3, a glove 10 is shown worn on the hand of a user during application of a clear conductive ink by a spraying technique, according to another embodiment. In this embodiment, a clear conductive ink 22 may be contained within a spray container 26 and may be sprayed onto a desired portion, such as a tip of at least one sheath 12, of the glove 10 as shown. The container 26 may include a pressurized pump sprayer or an aerosol spray container, according to a couple of embodiments. The user may easily carry the spray container 26 and apply a clear conductive ink 22 to the glove 10 as needed to provide enhanced electrically conductivity characteristics to the glove 10 to enable enhanced operation or interaction with proximity sensors or switches. It should be appreciated that the clear conductive ink 22 may be applied to the glove 10 when the glove 10 is worn by a user or the conductive ink 22 may be applied to the glove 10 absent insertion of the hand and finger within the glove 10.

The clear or physically transparent conductive ink 22 may include a commercially available off the shelf conductive ink, such as EL-P ink sold under the brand name Orgacon™, such as EL-P 3000, which is made commercially available by AGFA, according to one example. Orgacon™ EL-P ink is a highly transparent, screen printable conductive ink, based on conductive polymers. The ink includes conductive polymers and a thermoplastic polymer binder. The liquid ink may be applied as a patch or in a desired pattern. The transparent conductive ink 22 may include a commercially available off the shelf conductive ink sold under the brand name Clevios™ P which is commercially available by Heraeus, according to another example. It should be appreciated that other conductive inks may be employed to provide an enhanced electrical conductivity to the glove 10. It should further be appreciated that other techniques for applying the liquid conductive ink to one or more portions of the glove 10 may be employed.

The transparent conductive ink 22 is applied as a liquid that coats a surface portion of the glove 10 and may soak into the layer or layers of the glove 10. The liquid ink may soak all the way through from the outside to the inside of the glove 10, thereby providing an enhanced conductive path through the glove thickness to the finger of a user. This may be particularly advantageous for use with single electrode capacitive switches which include a proximity sensor such as a capacitive sensor which may use the added conductive path through the glove formed by the conductive ink to provide a ground path to the user. Gloves that are capable of absorbing the liquid ink include cloth gloves, such as cotton, wool, polyester, leather and other liquid permeable materials. By allowing the ink to soak through the glove 10, thicker gloves may be provided with greater conductivity and enhanced sensor operation. It should further be appreciated that the conductive ink could be applied to both the outside surface of the glove and the inside surface, and may be applied using other techniques such as an eye dropper. The viscosity of the conductive ink may vary, depending upon the permeability of the glove so as to realize sufficient permeation of the ink into the glove.

The enhanced electrical conductivity glove 10 achieved with the conductive ink as shown and described herein may be employed to operate proximity sensors, such as capacitive sensors, which generate sense activation fields and sense changes to the activation fields indicative of user activation of the sensors, typically caused by the user's finger in close proximity to or contact with each sensor. With the added electrical conductivity of the conductive ink 22, the gloved finger provides enhanced activation of a proximity sensor. The glove 10 may be operable to interact with a proximity sensor configured as a capacitive sensor, according to one embodiment. The capacitive sensor may function as a capacitive switch comparing the sensed activation field to a threshold. According to other embodiments, the glove 10 may interact with other proximity sensors, such as an inductive sensor or a resistive sensor, wherein the conductive ink provides enhanced interaction with the sense activation field of the proximity sensor.

The glove 10 may be advantageously utilized to operate one or more proximity sensors on an automotive vehicle so as to control one or more devices or perform one or more control functions. For example, proximity sensors may be used as user actuated switches, such as switches for operating devices including powered windows, headlights, windshield wipers, moonroofs or sunroofs, interior lighting, radio and infotainment devices, and various other devices. For automotive applications, proximity sensors may be located in overhead consoles, center consoles, headliners, doors, visors, instrument panel clusters, navigation displays and other areas on the vehicle. Users may advantageously be able to operate the proximity sensors in various temperature conditions including extreme cold conditions where the use of a glove is desirable or necessary. Additionally, work vehicles may be equipped with proximity sensors that interact with the enhanced conductivity glove 10, thereby allowing workers in the vehicle to wear their gloves to operate various sensors onboard the vehicle. The glove 10 may further be used to operate various other proximity sensors, such as capacitive sensors, for other applications. For example, phones, computers, PDAs, games, and other consumer electronic devices may employ proximity sensors, such as capacitive sensors, that may be operated with enhanced performance with the use of the glove 10.

Figure 4:
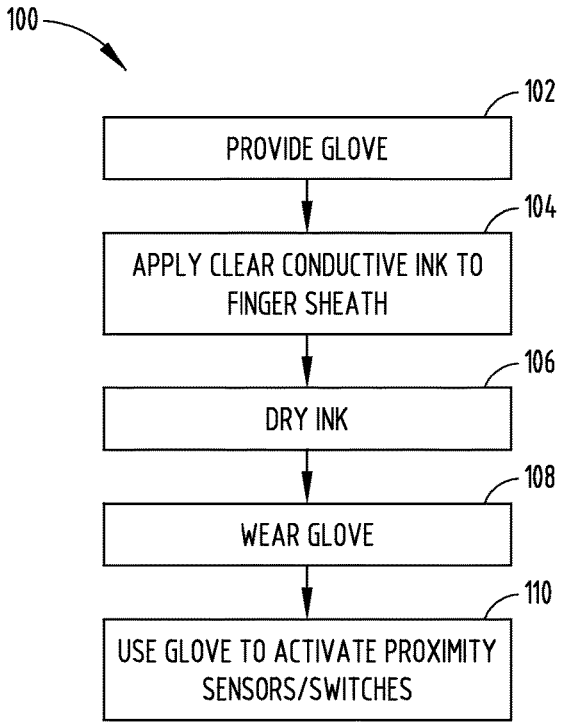
FIG. 4 is a flow diagram illustrating a method of applying a conductive ink to a glove and interacting with a proximity sensor therewith, according to one embodiment.

Referring to FIG. 4, a method of enhancing the electrical conductivity of a glove and interacting the glove with a capacitive sensor is illustrated, according to one embodiment. Method 100 includes step 102 of providing a glove. The glove may include any of a variety of types of gloves such as an off the shelf commercially available glove. The glove may be made of electrically non-conductive material, such as leather, cotton, rubber and other materials, and may have any desired thickness and insulation properties. At step 104, method 100 applies a clear conductive ink to at least one finger sheath, particularly to the tip portion where a finger of the hand is adapted to be present when the glove is worn. The clear conductive ink may be applied at a sufficient amount for a sufficient time period to allow the ink to soak into the glove, for a liquid permeable glove. Next, at step 106, method 100 dries the conductive ink that was applied to the glove such that the ink cures. Once dried, the ink may form a conductive path on the surface of the glove and extending through the layers of the glove so as to provide a conductive path to the finger of a user wearing the glove. Once the ink is dried, method 100 proceeds to step 108 to allow a user to wear the glove to cover the user's fingers and hand. With the glove worn on the hand, a user may proceed to step 110 to use the glove to activate one or more proximity sensors or switches. The interaction of the dried conductive ink of the glove provides for enhanced electric conductivity which provides for enhanced detection or interaction with proximity sensors.

Figure 5:
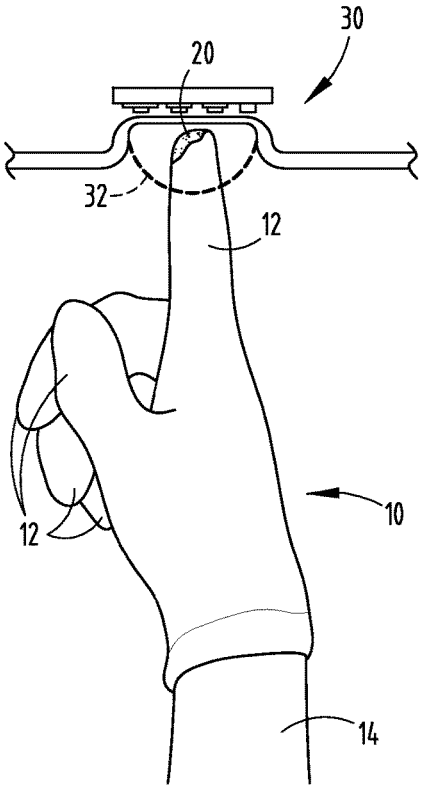
FIG. 5 is a side perspective view illustrating use of the glove with conductive ink to interact with a proximity sensor.

One example of the glove 10 having a conductive ink 20 applied to a tip of the sheath 12 and used to interact with a proximity sensor is illustrated in FIG. 5. A user wearing the glove 10 may simply swipe through a sense activation field 32 provided by a capacitive sensor 30 as shown. The finger, glove, and the enhanced conductive ink 20 provides a disturbance to the sense activation field 32 which is detected by the sensor 30 and used to determine activation of the proximity sensor by the user, which may allow for enhanced control of one or more devices or functions.

Accordingly, the glove 10 having a clear conductive ink applied thereto advantageously allows for many forms of gloves to be employed to provide enhanced interaction with a capacitive sensor. The method of interacting with the glove 10 advantageously allows users to provide enhanced capacitive sensing operation without the need to substantially modify the glove 10 or require that a user buy a special manufactured glove, or to remove the glove. This results in enhanced use of the capacitive sensors for users that wear gloves.

It is to be understood that variations and modifications can be made on the aforementioned structure without departing from the concepts of the present invention, and further it is to be understood that such concepts are intended to be covered by the following claims unless these claims by their language expressly state otherwise.

We claim:

1. A glove comprising:

a body configured to engage a hand;

a plurality of finger sheaths configured to cover fingers of the hand; and an electrically conductive ink disposed on at least one of the finger sheaths, wherein the electrically conductive ink penetrates through and extends from an outside surface to an innermost surface of the glove to provide a conductive ground path through a thickness of the glove configured to ground a proximity sensor to a finger of the hand.

2. The glove of claim 1, wherein the electrically conductive ink comprises a visibly clear conductive ink.

3. The glove of claim 2, wherein the clear conductive ink comprises a conductive polymer.

4. The glove of claim 1, wherein the electrically conductive ink is disposed on a tip of the at least one finger sheath.

5. The glove of claim 1, wherein the conductive ink is applied to the glove by dipping at least a portion of the at least one finger sheath in a liquid conductive ink.

6. The glove of claim 1, wherein the conductive ink is applied to the glove by spraying the liquid conductive ink onto the at least one finger sheath.

7. The glove of claim 1, wherein the conductive ink is applied on the outer surface of the at least one finger sheath.

8. The glove of claim 1, wherein the glove is adapted to operate a capacitive sensor in an automotive vehicle.

9. A glove comprising:

a body configured to receive a hand;

a plurality of finger sheaths configured to cover fingers of the hand; and an electrically conductive material formed on at least one of the finger sheaths by applying a liquid conductive ink to the at least one finger sheath and drying the conductive ink, wherein the electrically conductive ink penetrates through and extends from an outside surface to an innermost surface of the glove to provide a conductive ground path through a thickness of the glove configured to ground a proximity sensor to a finger of the hand.

10. The glove of claim 9, wherein the liquid conductive ink is applied by dipping at least a portion of the at least one finger sheath in liquid ink.

11. The glove of claim 9, wherein the liquid conductive ink is applied by spraying the liquid conductive ink onto the at least one finger sheath.

12. The glove of claim 9, wherein the liquid conductive ink comprises a conductive polymer.

13. The glove of claim 9, wherein the electrically conductive ink is applied to a top of the at least one finger sheath.

14. A glove comprising:

a body configured to engage and cover a hand including fingers of the hand; and an electrically conductive ink disposed on the body, wherein the electrically conductive ink penetrates through and extends from an outside surface to an innermost surface of the glove to provide a conductive ground path through a thickness of the glove configured to ground a proximity sensor to a finger of the hand.

15. The glove of claim 14, wherein the electrically conductive ink comprises a visibly clear conductive ink.

16. The glove of claim 14 further comprising at least one finger sheath, wherein the electrically conductive ink is disposed near a tip of the at least one finger sheath.

* * * * *